US008720474B2

(12) United States Patent
Wang

(10) Patent No.: US 8,720,474 B2
(45) Date of Patent: May 13, 2014

(54) ATTACHMENT FOR DIFFERENT AIR VALVES

(75) Inventor: Lo Pin Wang, Taichung (TW)

(73) Assignee: Beto Engineering & Marketing Co., Ltd., Beitun Taichung (TW)

( * ) Notice: Subject to any disclaimer, the term of this patent is extended or adjusted under 35 U.S.C. 154(b) by 110 days.

(21) Appl. No.: 13/373,654

(22) Filed: Nov. 23, 2011

(65) Prior Publication Data

US 2013/0126771 A1 May 23, 2013

(51) Int. Cl.
*F16K 15/20* (2006.01)

(52) U.S. Cl.
USPC ..... 137/231; 137/223

(58) Field of Classification Search
USPC ..... 137/223, 231
See application file for complete search history.

(56) References Cited

U.S. PATENT DOCUMENTS

| | | | | |
|---|---|---|---|---|
| 4,334,839 | A | 6/1982 | Flagg | |
| 4,842,489 | A | 6/1989 | Lucisano | |
| 5,683,234 | A | 11/1997 | Chuang et al. | |
| 5,960,815 | A * | 10/1999 | Wang | 137/118.03 |
| 6,786,247 | B1 * | 9/2004 | Kemppainen et al. | 141/84 |
| 7,866,335 | B2 | 1/2011 | Wang | |
| 2009/0229677 | A1 * | 9/2009 | Wang | 137/231 |

* cited by examiner

*Primary Examiner* — John Rivell
*Assistant Examiner* — R. K. Arundale
(74) *Attorney, Agent, or Firm* — Charles E. Baxley

(57) ABSTRACT

An air valve connecting device or attachment includes a housing having an inlet mouth, a gasket engaged into the housing for engaging with an inflation valve, a casing engaged in the housing for compressing the gasket to grasp the inflation valve to the housing, and the casing includes a compartment communicative with the gasket for engaging with a valve piece which selectively blocks the casing, a spring biases the valve piece to engage with the casing, an actuator is engageble with the casing for compressing the gasket to grasp the inflation valve to the housing, and the actuator includes a valve member for preventing an air leaking problem from being occurred by the inflation valves.

8 Claims, 7 Drawing Sheets

ATTACHMENT FOR DIFFERENT AIR VALVES

BACKGROUND OF THE INVENTION

1. Field of the Invention

The present invention relates to an air valve connecting head or device or attachment, and more particularly to an air valve connecting device or attachment including an improved structure for connecting to different inflation valves and for preventing an air leaking from the inflation valves and the attachment.

2. Description of the Prior Art

Typical air valve connecting devices or attachments comprise a fitting port formed in one end of a valve housing for receiving or engaging with an inflation valve and for inflating the balls, the inner tires of the bicycles or the motorcycles or the vehicles, or other inflatable articles.

For example, U.S. Pat. No. 4,334,839 to Flagg discloses one of the typical hand operated, dual chambered, pneumatic pumps comprising a twin piston air pump for pumping air under pressure in both directions, and a fitting member for engaging with an inflation valve.

However, normally, the typical air valve connecting heads or fittings may only be used for engaging with a single inflation valve only, such as a U.S. type valve and a French type valve, but may not be used for engaging with both of the inflation valves.

U.S. Pat. No. 4,842,489 to Lucisano, U.S. Pat. No. 5,683,234 to Chuang et al., and U.S. Pat. No. 7,866,335 to Wang disclose other typical air valve connecting heads for the hand-held air pump and comprising a fitting device or attachment for selectively or alternatively engaging with different tire valves, such as the U.S. type inflation valve or the French type inflation valve, or the like.

However, the typical air valve connecting heads or attachments comprise a structure that may not be easily operated or may not effectively grasping or holding the different inflation valves, and may have an air leaking problem occurred through either the inflation valve or the attachment.

The present invention has arisen to mitigate and/or obviate the afore-described disadvantages of the conventional air valve connecting devices or attachments.

SUMMARY OF THE INVENTION

The primary objective of the present invention is to provide an air valve connecting device or attachment including an improved structure for connecting to different inflation valves and for preventing an air leaking from the inflation valves and the attachment.

In accordance with one aspect of the invention, there is provided an air valve connecting device comprising a housing including a chamber formed therein, and including an inlet mouth for receiving a pressurized air, a gasket engaged into the chamber of the housing and including a bore formed therein for engaging with an inflation valve, a casing slidably engaged in the chamber of the housing and engaged with the gasket for selectively compressing the gasket to grasp and retain the inflation valve to the housing, and the casing including a compartment formed therein and communicative with the bore of the gasket, a valve piece slidably engaged in the compartment of the casing and extendible into the bore of the gasket for engaging with the inflation valve, and the valve piece being engageable with the casing and for selectively blocking the compartment of the casing, a first spring biasing member for biasing the valve piece to engage with the casing, an actuator slidably engaged in the chamber of the housing and engageable with the casing for selectively forcing the casing to compress the gasket to grasp and retain the inflation valve to the housing, and the actuator including a peripheral pathway communicative with the inlet mouth of the housing for receiving the pressurized air from the inlet mouth, and including an aperture formed therein, and including a channel formed therein and communicative with the aperture and the peripheral pathway for allowing the pressurized air from the inlet mouth of the housing to flow into the peripheral pathway and the aperture of the actuator, and including a valve seat extended into the aperture of the actuator, a valve member disposed in the aperture of the actuator and movable to engage with the valve seat and to block the aperture of the actuator by the pressurized air, and a handle pivotally attached to the housing and including a cam member for engaging with the actuator and for selectively forcing the actuator to force the casing to compress the gasket and to grasp and retain the inflation valve to the housing.

The casing includes a swelling extended therefrom and having a passage formed in the swelling and communicative with the compartment of the casing, the valve member is engageable with the swelling of the casing. The casing includes a second compartment formed therein and communicative with the passage of the swelling of the casing.

The housing includes a second gasket engaged into the chamber of the housing and includes a bore formed therein and communicative with the second compartment of the casing. The casing includes a second valve piece slidably engaged in the second compartment of the casing and extendible into the bore of the second gasket.

The casing includes a peripheral flange extended into the compartment of the casing, and a sealing ring engaged in the compartment of the casing and engageable with the peripheral flange of the casing, and the valve piece is engageable with the sealing ring for selectively forcing the sealing ring to engage with the peripheral flange of the casing and to block the compartment of the casing.

The actuator includes a stepped depression formed therein and communicative with the aperture of the actuator, and a valve element slidably engaged in the stepped depression of the actuator, and a sealing ring engaged in the stepped depression of the actuator and engageable with the valve element and the actuator for selectively blocking the stepped depression and the aperture of the actuator.

The actuator includes an upper sealing ring and a lower sealing ring slidably engaged with the housing, and the peripheral pathway of the actuator is formed between the upper and the lower sealing rings and communicative with the inlet mouth of the housing. The housing includes a bottom wall having an opening formed therein and communicative with the bore of the gasket.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
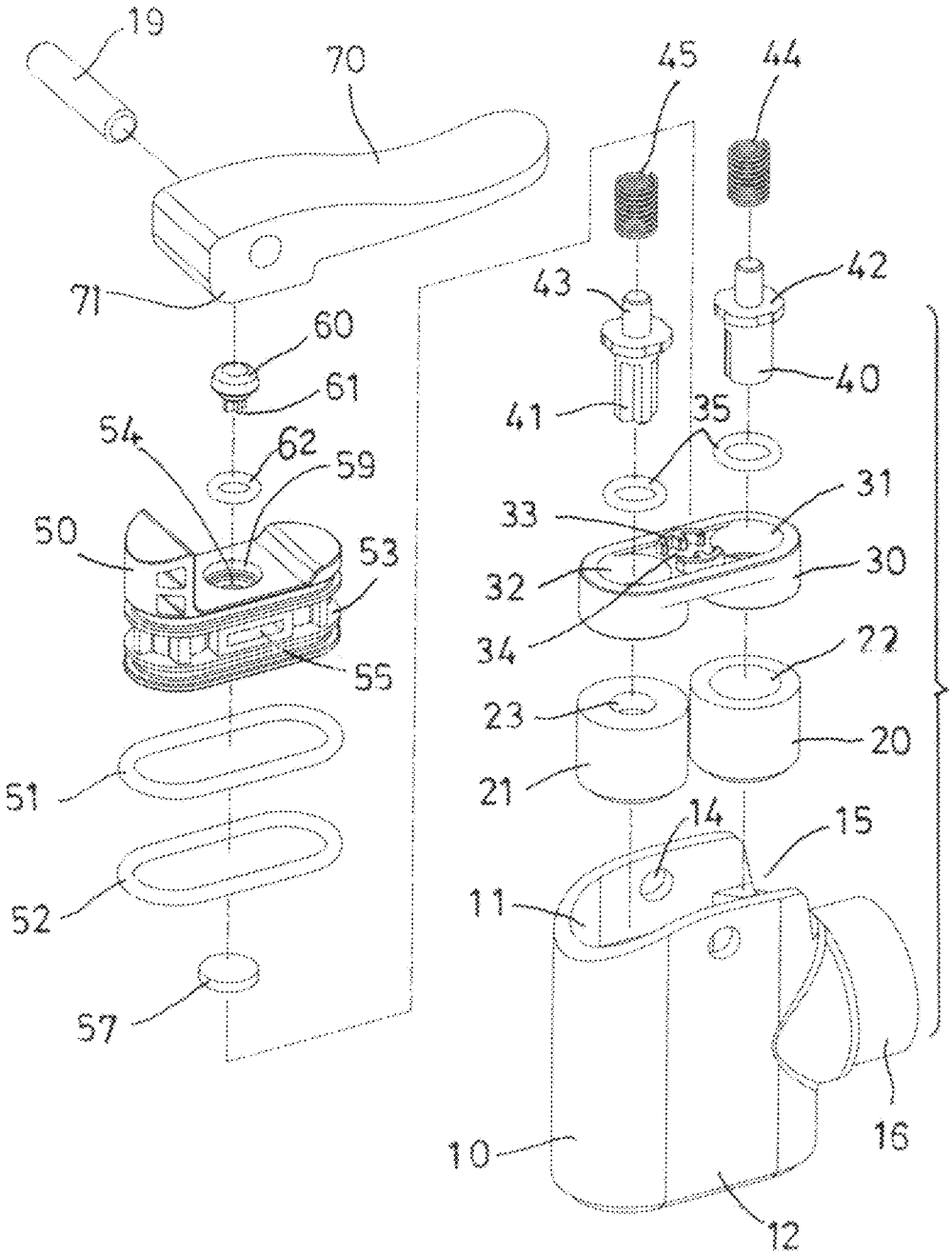
FIG. 1 is an exploded view of an air valve connecting device or attachment in accordance with the present invention.
Figure 2:
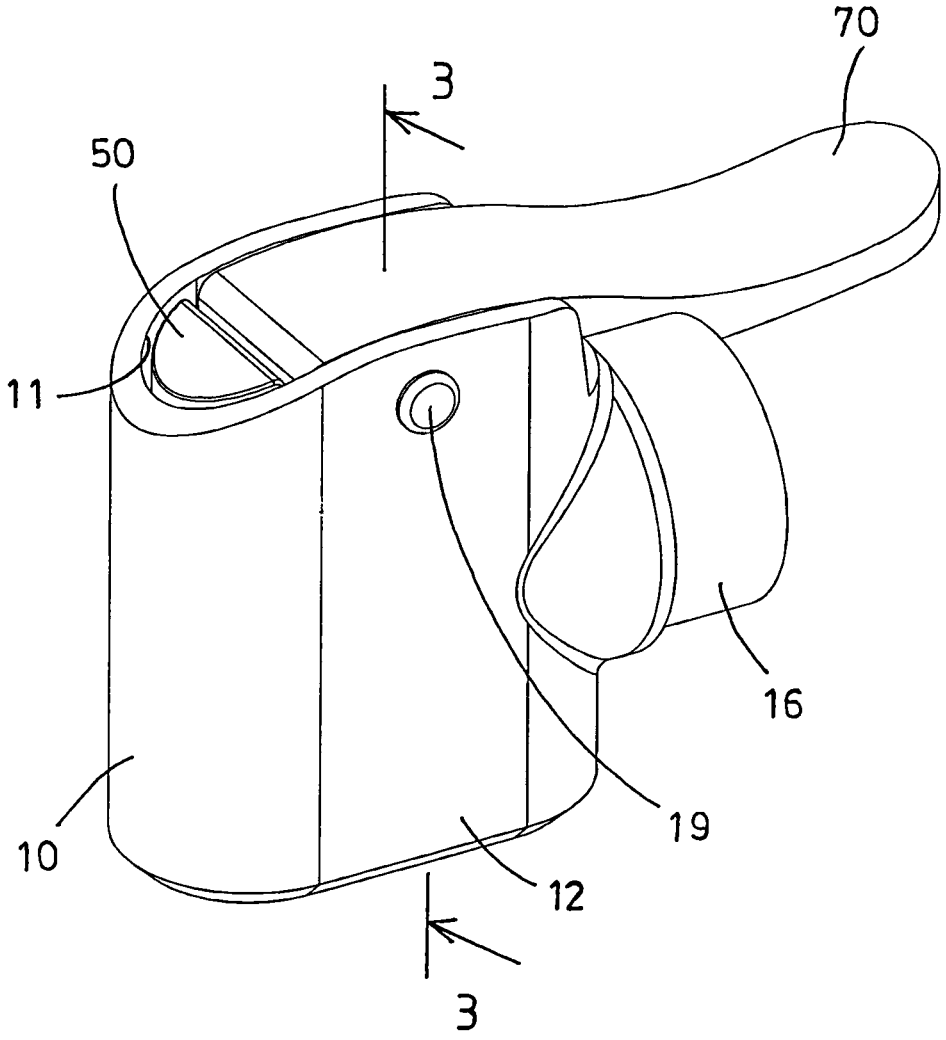
FIG. 2 is a perspective view of the air valve connecting device or attachment.
Figure 3:
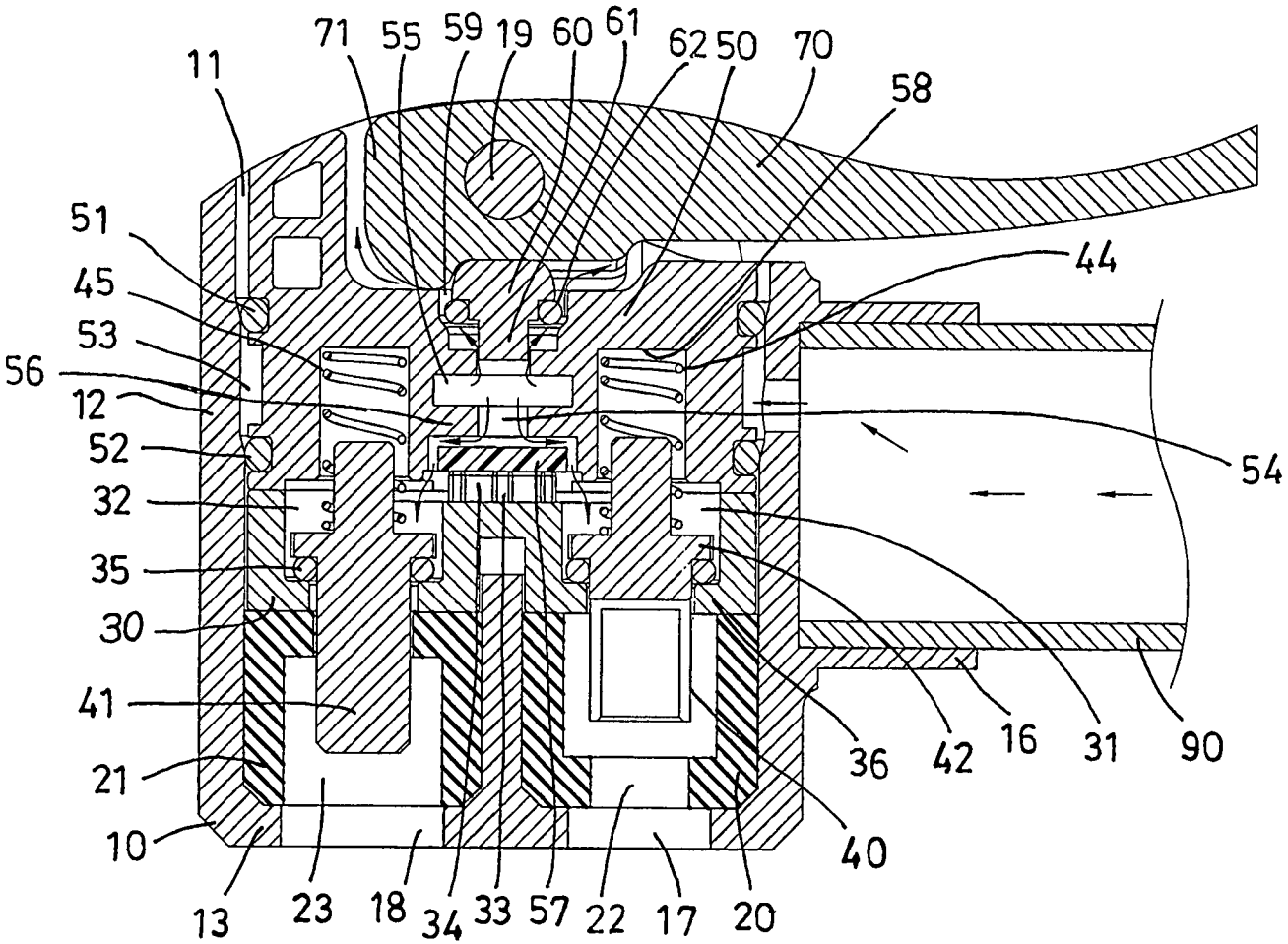
FIG. 3 is a cross sectional view of the air valve connecting device or attachment taken along lines 3-3 of FIG. 2.

Referring to the drawings, and initially to FIGS. 1-3, an air valve connecting device or attachment in accordance with the present invention comprises a head body or housing 10 including a chamber 11 formed therein and formed or defined by an outer peripheral wall 12 and a bottom wall 13, and including a lateral orifice 14 formed therein, such as formed in the upper portion of the housing 10 and communicative with the chamber 11 of the housing 10 for receiving or engaging with an axle 19 which is laterally extended through the chamber 11 of the housing 10, and including a notch 15 formed in the rear and upper portion of the housing 10 and communicative with the chamber 11 of the housing 10, and including an inlet mouth 16 laterally or rearwardly extended from the housing 10 and substantially perpendicular to the housing 10 for coupling to an air pump 90 or the like and for receiving the pressurized air from the air pump 90.

Figure 4:
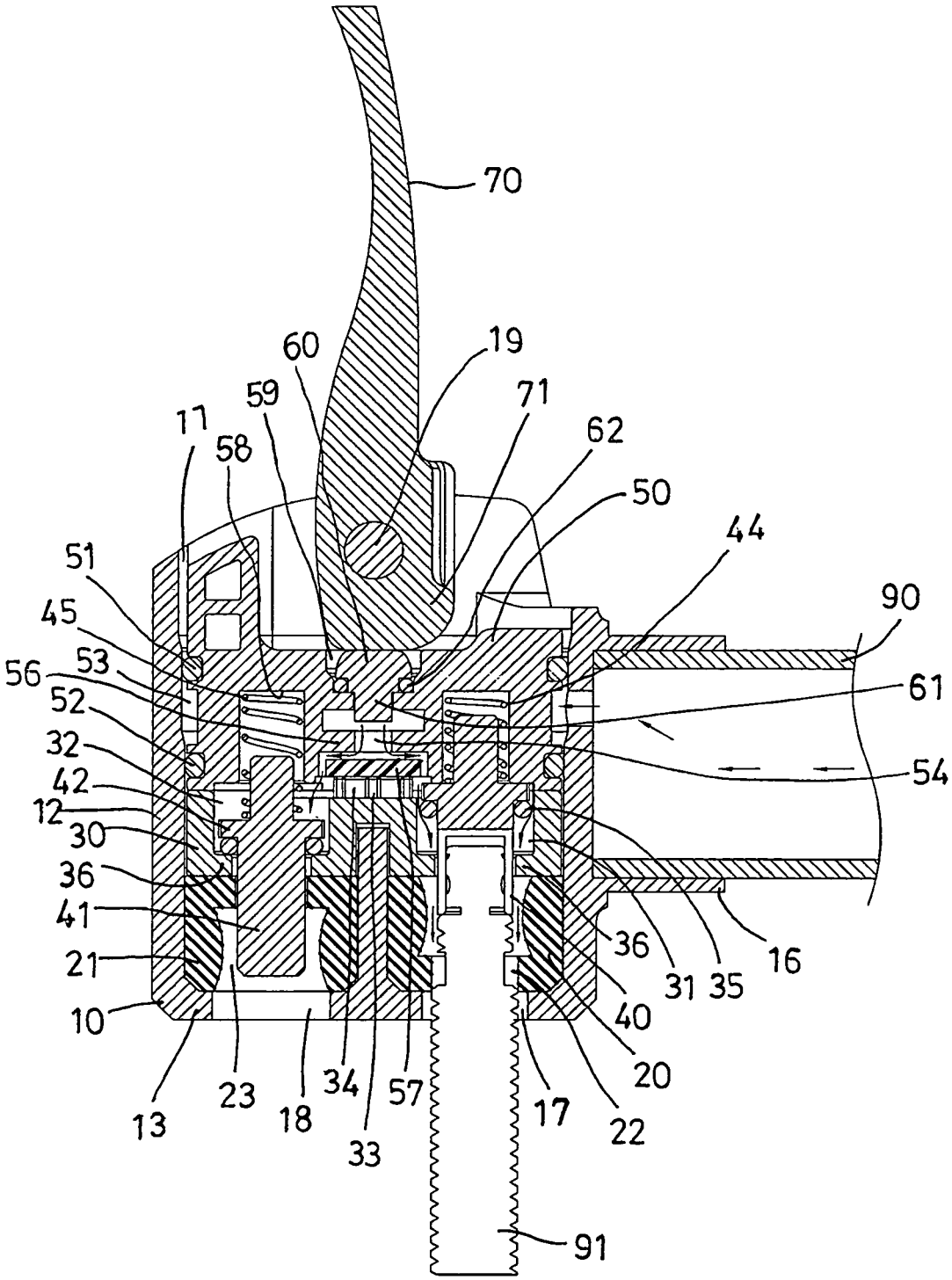
FIGS. 4, 5 are cross sectional views similar to FIG. 3, illustrating the operation of the air valve connecting device or attachment.
Figure 5:
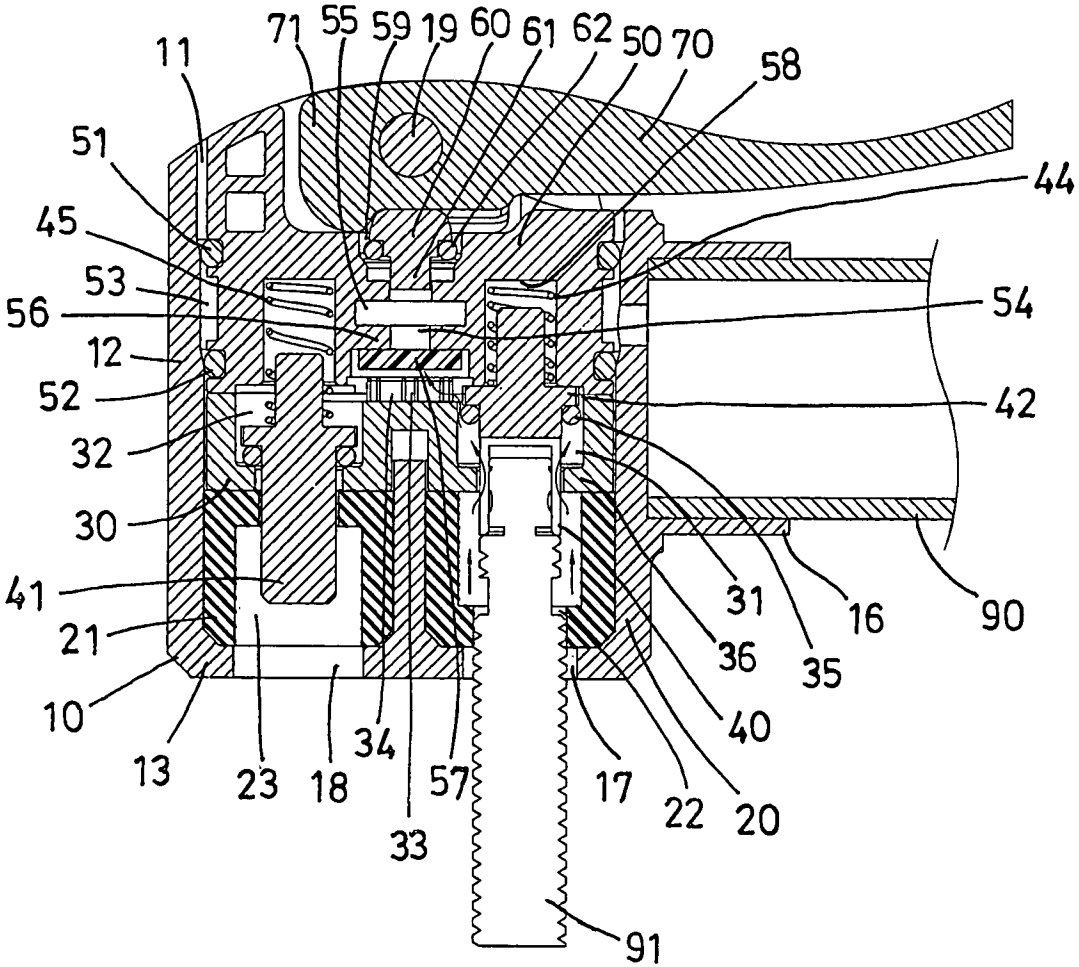
Figure 6:
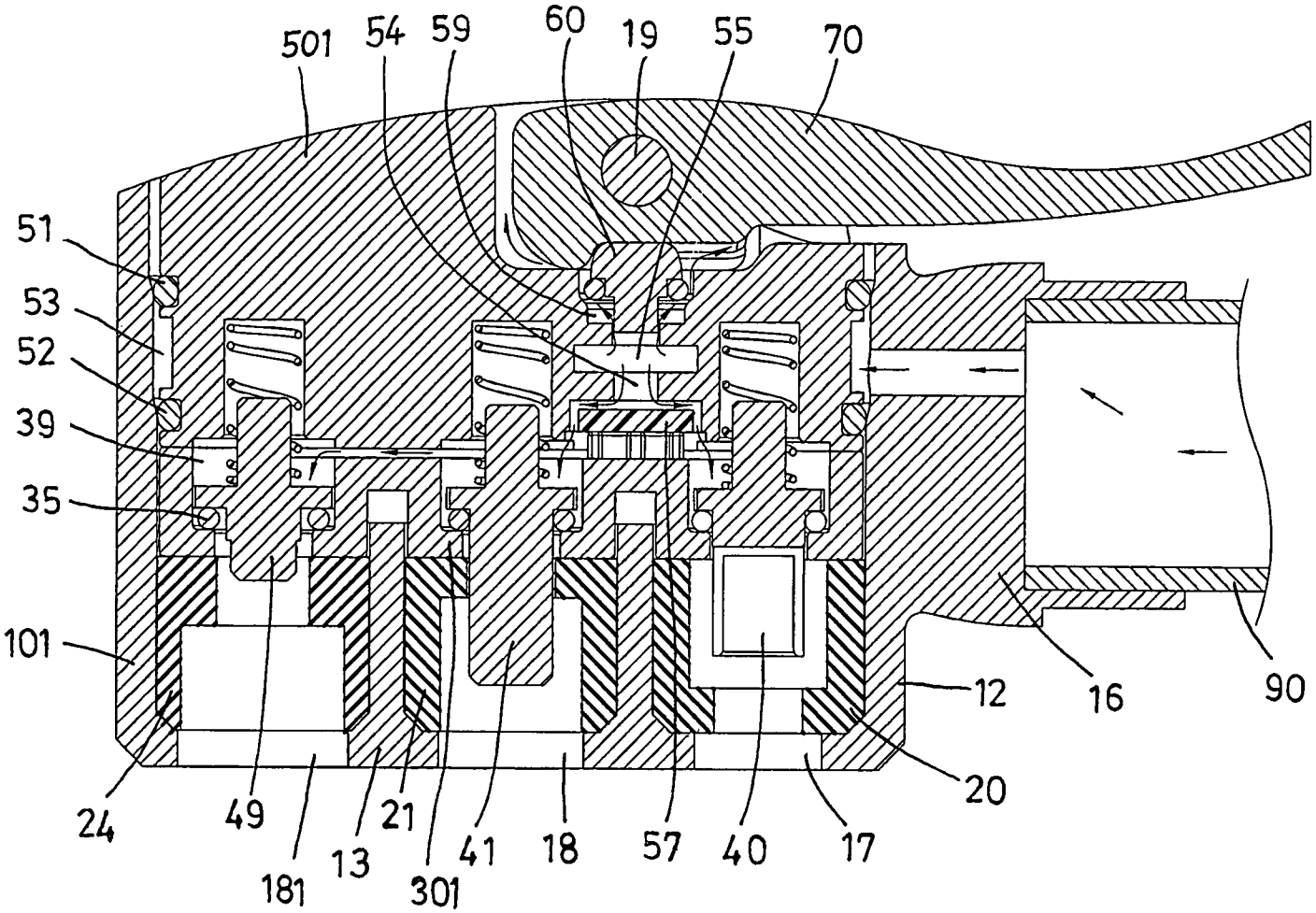
FIGS. 6, 7 are cross sectional views similar to FIGS. 3-5, illustrating the other arrangement of the air valve connecting device or attachment.
Figure 7:
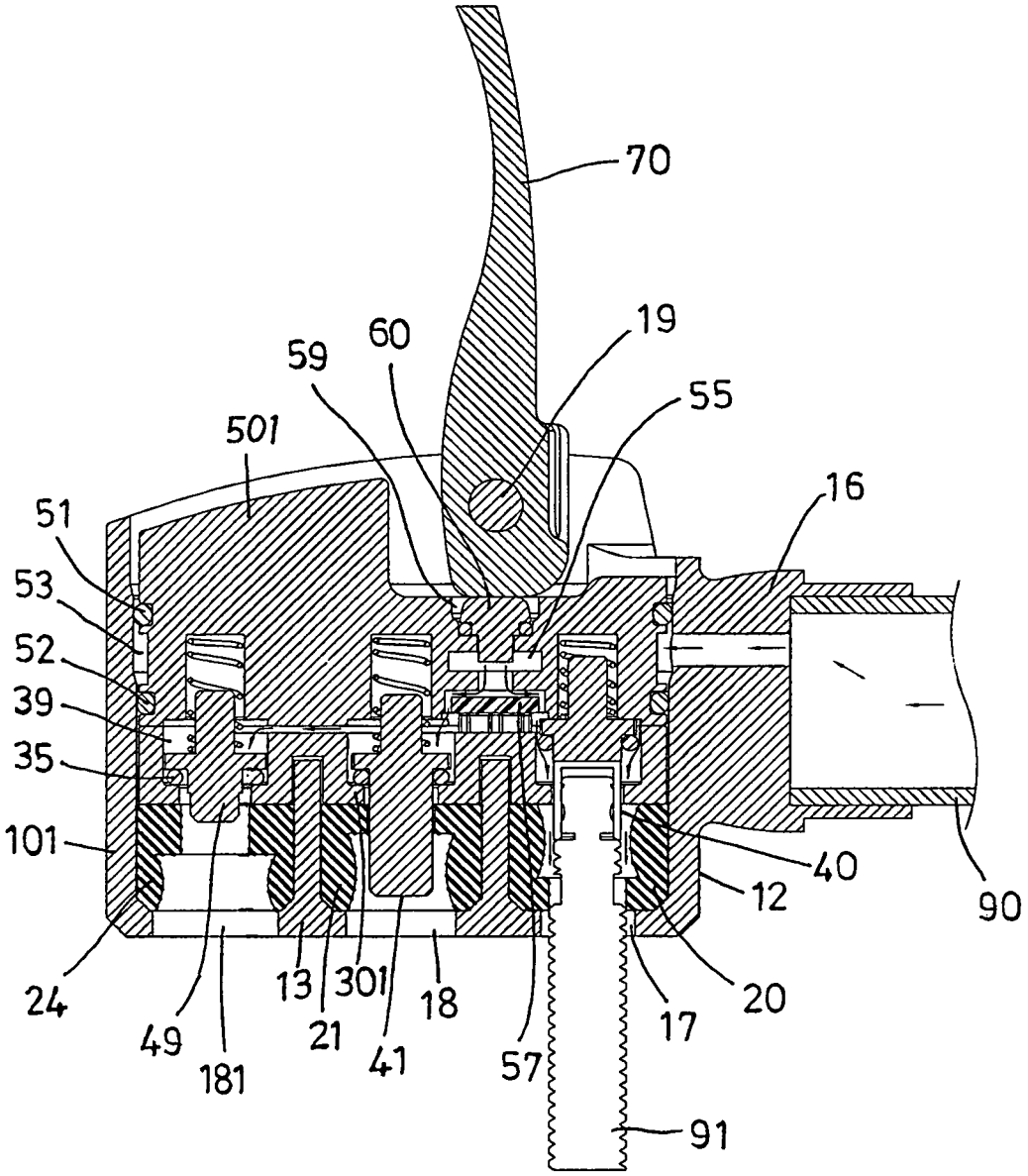

As shown in FIGS. 3-5, the bottom wall 13 of the housing 10 includes two or more openings 17, 18 formed therein for receiving or engaging with the inflation valves 91, such as the U.S. type valve (not shown) and the French type valve 91 (FIGS. 4-5) or the like. The housing 10 is opened upwardly for allowing the other parts or elements to be introduced or engaged into the chamber 11 of the housing 10 through the opened upper portion of the chamber 11 of the housing 10. For example, two or more elastic grasping members or mouths or gaskets 20, 21 may be attached or engaged into the chamber 11 of the housing 10 and contacted or engaged with the bottom wall 13 of the housing 10 which may anchor or secure or retain the gaskets 20, 21 in the chamber 11 of the housing 10. Alternatively, as shown in FIGS. 6-7, the housing 101 may further include one or more further openings 181 formed therein, when required, for receiving or engaging with the other or further inflation valves (not shown).

The gaskets 20, 21 each include a bore 22, 23 formed therein and having a predetermined size or dimension or standard for receiving or engaging with the inflation valves 91, and the gaskets 20, 21 are made of soft or elastic materials, such as rubber, plastic or other synthetic materials and include a suitable or predetermined softness or resilience for being selectively depressed or compressed or squeezed or deformed to grip or grasp or hold or retain the inflation valves 91 to the housing 10. Alternatively, as shown in FIGS. 6-7, one or more further gaskets 24 may further be provided and disposed or engaged into the chamber 11 of the housing 101 and contacted or engaged with the bottom wall 13 of the housing 101 for engaging with the other or further inflation valves (not shown). The number of the openings 17, 18, 181 formed in the bottom wall 13 of the housing 101 and the number of the gaskets 20, 21, 24 may be selected and determined by the user.

A follower or sliding member or piston or casing 30 is slidably or movably disposed or engaged into the chamber 11 of the housing 10 and contacted or engaged with the gaskets 20, 21 for selectively depressing or compressing or squeezing or deforming the gaskets 20, 21 to grip or grasp or hold or retain the inflation valves 91 to the housing 10, and includes two or more compartments 31, 32 formed therein for aligning or communicative with the bores 22, 23 of the gaskets 20, 21 respectively, and includes a bulge or seat or swelling 33 extended upwardly from the casing 30 and having a passage 34 formed therein and communicative with the compartments 31, 32 of the casing 30, and includes a sealing ring 35 disposed or engaged into each of the compartments 31, 32 of the casing 30, and includes a peripheral flange 36 extended laterally and inwardly into each of the compartments 31, 32 of the casing 30 for engaging with the sealing rings 35 and for anchoring or securing or retaining the sealing rings 35 in the compartments 31, 32 of the casing 30 respectively and for preventing the sealing rings 35 from being disengaged from the casing 30.

A valve pressing member or tube or valve piece 40, 41 is slidably engaged in each of the compartments 31, 32 of the casing 30 respectively and slidable or extendible into the respective bore 22, 23 of the gasket 20, 21 for selectively engaging with the inflation valves 91, such as the French type valve 91 and the U.S. type valve and the like, and the valve pieces 40, 41 each include a peripheral flange or stop 42 extended laterally and outwardly therefrom for contacting or engaging with the sealing rings 35 and for selectively forcing or pressing the sealing rings 35 onto the peripheral flanges 36 of the casing 30, and thus for selectively making a water or air tight seal with the casing 30 and/or for selectively blocking the compartments 31, 32 of the casing 30, and the valve pieces 40, 41 each include a stud 43 extended upwardly therefrom for engaging with a spring biasing means or member 44, 45 which may bias and force the valve pieces 40, 41 to engage with and to press the sealing rings 35 onto the peripheral flanges 36 of the casing 30.

An actuating member or piston or follower or sliding member or actuator 50 is slidably engaged into the chamber 11 of the housing 10 and disposed or located above the casing 30 for contacting or engaging with the casing 30, and includes an upper sealing ring 51 and a lower sealing ring 52 attached or mounted or secured onto the outer peripheral portion thereof for slidably engaging with the inner peripheral portion of the housing 10 and for making a water tight or air tight seal between the actuator 50 and the housing 10, and includes an outer peripheral recess or pathway 53 formed or defined between the upper and the lower sealing rings 51, 52 and aligned with or communicative with the inlet mouth 16 of the housing 10 for receiving the pressurized air from the air pump 90, and includes a central or middle aperture 54 formed therein, and includes a groove or channel 55 formed therein and intersected or communicative with the aperture 54 and the peripheral pathway 53 for allowing the pressurized air from the air pump 90 to flow through the inlet mouth 16 of the housing 10 and to flow into the peripheral pathway 53 and the aperture 54 of the actuator 50.

As shown in FIGS. 3 and 4, the aperture 54 of the actuator 50 is communicative with the passage 34 of the swelling 33 and the compartments 31, 32 of the casing 30 for allowing the pressurized air to selectively flow into the compartments 31, 32 of the casing 30 and then to selectively flow into the bores 22, 23 of the gaskets 20, 21 respectively for supplying the pressurized air to the respective inflation valves 91. The spring biasing means or members 44, 45 may normally bias and force the valve pieces 40, 41 to engage with and to press the sealing rings 35 onto the peripheral flanges 36 of the casing 30 for selectively sealing the compartments 31, 32 of the casing 30 and for preventing the pressurized air from being supplied to the inflation valves 91. As shown in FIGS. 4 and 5, the pressurized air may flow into and out of or between the compartments 31, 32 of the casing 30 and the bores 22, 23 of the gaskets 20, 21 when either of the valve pieces 40, 41 is selectively disengaged from the peripheral flanges 36 of the casing 30 with the inflation valves 91.

The actuator 50 includes a peripheral flange or stop or valve seat 56 extended laterally and inwardly into the aperture 54 of the actuator 50, and a valve member 57 is loosely and movably disposed or engaged in the aperture 54 of the actuator 50 and normally contacted or engaged with the swelling 33 of the casing 30 due to the gravity force, and normally disengaged or spaced from the valve seat 56 of the actuator 50 for allowing the air to selectively flow through the aperture 54 of the actuator 50 (FIGS. 3, 4). The valve member 57 may be selectively forced to engage with the valve seat 56 and to block the aperture 54 of the actuator 50 (FIG. 5) by the pressurized air. The actuator 50 includes two or more cavities 58 formed therein for receiving or engaging with the spring biasing members 44, 45 and for anchoring or securing or retaining the spring biasing members 44, 45 between the actuator 50 and the valve pieces 40, 41, and includes a stepped depression 59 formed in the upper portion thereof and communicative with the aperture 54 of the actuator 50.

A valve element 60 is slidably engaged in the stepped depression 59 of the actuator 50 and includes a stem or leg or shank 61 extended downwardly therefrom for selectively engaging into the aperture 54 of the actuator 50, and includes a gasket or sealing ring 62 disposed or engaged into the stepped depression 59 of the actuator 50 and engageable with the valve element 60 and the actuator 50 for selectively making a water tight or air tight seal between the actuator 50 and the valve element 60 and for selectively blocking the stepped depression 59 and the aperture 54 of the actuator 50, the pressurized air from the air pump 90 and the inlet mouth 16 of the housing 10 may selectively flow into the aperture 54 of the actuator 50 and may selectively move or disengage the valve element 60 from the actuator 50 and may selectively open the stepped depression 59 and the aperture 54 of the actuator 50.

An actuating handle 70 is attached or mounted or secured or coupled to the axle 19 for pivotally or rotatably attaching or mounting or securing the actuating handle 70 to the housing 10 and for allowing the actuating handle 70 to be pivoted or rotated relative to the housing 10 to selected angular positions. The actuating handle 70 includes a cam member 71 formed or provided on the one end portion thereof for selectively engaging with the valve element 60 and the actuator 50 and for selectively forcing or moving the valve element 60 to block the stepped depression 59 and the aperture 54 of the actuator 50, and for selectively forcing or actuating the actuator 50 to move toward the casing 30 and the gaskets 20, 21, and for selectively forcing or actuating the casing 30 to selectively depress, or compress or squeeze or deform the gaskets 20, 21 and to grip or grasp or hold or retain the inflation valves 91 to the housing 10.

In operation, as shown in FIG. 3, when no inflation valves have been engaged into the openings 17, 18 of the housing 10, the spring biasing members 44, 45 may bias and force the valve pieces 40, 41 to engage with and to press the sealing rings 35 onto the peripheral flanges 36 of the casing 30 for selectively sealing the compartments 31, 32 of the casing 30 and for preventing the pressurized air from being supplied to the inflation valves 91. At this moment, the pressurized air from the air pump 90 may flow through the inlet mouth 16 of the housing 10 and may flow into the peripheral pathway 53 and the aperture 54 of the actuator 50, and may then flow into the stepped depression 59 of the actuator 50 for moving and forcing and disengaging the valve element 60 from the actuator 50 and for allowing the pressurized air to flow out of the actuator 50.

As shown in FIG. 4, when either of the inflation valves 91 is engaged into the opening 17, 18 of the housing 10, the inflation valve 91 may be engaged with the valve piece 40, 41 and may move or disengage the sealing rings 35 from the peripheral flange 36 of the casing 30 for selectively opening the compartment 31, 32 of the casing 30 and for allowing the pressurized air to flow into the bore 22, 23 of the gasket 20, 21 and to selectively supply the pressurized air to the respective inflation valve 91. The actuating handle 70 is then pivoted or rotated relative to the housing 10 to the perpendicular working position and to move and force the valve element 60 to block the stepped depression 59 of the actuator 50 and to move and force the actuator 50 and the casing 30 to selectively depress or compress or squeeze or deform the gaskets 20, 21 and to grip or grasp or hold or retain the inflation valve 91 to the housing 10. At this moment, the pressurized air may only be supplied to the inflation valve 91.

As shown in FIG. 5, after the air inflation operation is done, the actuating handle 70 is then pivoted or rotated relative to the housing 10 again to release the valve element 60 and to open the stepped depression 59 of the actuator 50 and to release the residual pressurized air out through the stepped depression 59 of the actuator 50. At this moment, the pressurized air from the inflation valve 91 may flow into the bore 22, 23 of the gasket 20, 21 and the compartment 31, 32 of the casing 30 and may flow into the passage 34 of the swelling 33 and may move and force the valve member 57 to selectively engage with the valve seat 56 and to block the aperture 54 of the actuator 50, and thus to prevent the air leaking problem from being occurred by the inflation valves. Similarly, when either of the inflation valves 91 is engaged into the opening 17, 18 of the housing 10 and before the air inflation operation is actuated, the valve member 57 may also be moved and forced to selectively engage with the valve seat 56 and to block the aperture 54 of the actuator 50, and thus to prevent the air leaking problem from being occurred by the inflation valves.

Alternatively, as shown in FIGS. 5-6, the casing 301 may further include one or more further compartments 39 formed therein for receiving or engaging with the other valve pieces 49, and the actuator 501 and the casing 301 may be forced or actuated or moved to selectively depress or compress or squeeze or deform the gaskets 20, 21, 24 and to grip or grasp or hold or retain the inflation valves 91 to the housing 101.

Accordingly, the air valve connecting device or attachment in accordance with the invention includes an improved structure for connecting to different inflation valves and for preventing an air leaking from the inflation valves and the attachment.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air valve connecting device comprising:

a housing including a chamber formed therein, and including an inlet mouth for receiving a pressurized air, a gasket engaged into said chamber of said housing and including a bore formed therein for engaging with an inflation valve, a casing slidably engaged in said chamber of said housing and engaged with said gasket for selectively compressing said gasket to grasp and retain the inflation valve to said housing, and said casing including a compartment formed therein and communicative with said bore of said gasket, said casing including a swelling extended therefrom and having a passage formed in said swelling and communicative with said compartment of said casing, a valve piece slidably engaged in said compartment of said casing and extendible into said bore of said gasket for engaging with the inflation valve, and said valve piece being engageble with said casing and for selectively blocking said compartment of said casing, a first spring biasing member for biasing said valve piece to engage with said casing, an actuator slidably engaged in said chamber of said housing and engageble with said casing for selectively forcing said casing to compress said gasket to grasp and retain the inflation valve to said housing, and said actuator including a peripheral pathway communicative with said inlet mouth of said housing for receiving the pressurized air from said inlet mouth, and including an aperture formed therein, and including a channel formed therein and communicative with said aperture and said peripheral pathway for allowing the pressurized air from said inlet mouth of said housing to flow into said peripheral pathway and said aperture of said actuator, and including a valve seat extended into said aperture of said actuator, a valve member engageble with said swelling of said casing and disposed in said aperture of said actuator and movable to engage with said valve seat and to block said aperture of said actuator by the pressurized air, and a handle pivotally attached to said housing and including a cam member for engaging with said actuator and for selectively forcing said actuator to force said casing to compress said gasket and to grasp and retain the inflation valve to said housing.

2. The air valve connecting device as claimed in claim 1, wherein said casing includes a second compartment formed therein and communicative with said passage of said swelling of said casing.

3. The air valve connecting device as claimed in claim 2, wherein said housing includes a second gasket engaged into said chamber of said housing and includes a bore formed therein and communicative with said second compartment of said casing.

4. The air valve connecting device as claimed in claim 3, wherein said casing includes a second valve piece slidably engaged in said second compartment of said casing and extendible into said bore of said second gasket.

5. The air valve connecting device as claimed in claim 1, wherein said housing includes a bottom wall having an opening formed therein and communicative with said bore of said gasket.

6. The air valve connecting device as claimed in claim 1, wherein said casing includes a peripheral flange extended into said compartment of said casing, and a sealing ring engaged in said compartment of said casing and engageble with said peripheral flange of said casing, and said valve piece is engageble with said sealing ring for selectively forcing said sealing ring to engage with said peripheral flange of said casing and to block said compartment of said casing.

7. The air valve connecting device as claimed in claim 1, wherein said actuator includes a stepped depression formed therein and communicative with said aperture of said actuator, and a valve element slidably engaged in said stepped depression of said actuator, and a sealing ring engaged in said stepped depression of said actuator and engageable with said valve element and said actuator for selectively blocking said stepped depression and said aperture of said actuator.

8. The air valve connecting device as claimed in claim 1, wherein said actuator includes an upper sealing ring and a lower sealing ring slidably engaged with said housing, and said peripheral pathway of said actuator is formed between said upper and said lower sealing rings and communicative with said inlet mouth of said housing.

* * * * *